US006769975B2

(12) United States Patent
Sagawa

(10) Patent No.: US 6,769,975 B2
(45) Date of Patent: Aug. 3, 2004

(54) SUPER ABRASIVE TOOL AND PROCESS FOR PRODUCING THE SAME

(75) Inventor: Masayuki Sagawa, Chiba (JP)

(73) Assignee: Asahi Diamond Industrial Co., Ltd., Tokyo (JP)

( * ) Notice: Subject to any disclaimer, the term of this patent is extended or adjusted under 35 U.S.C. 154(b) by 149 days.

(21) Appl. No.: 10/084,344

(22) Filed: Feb. 28, 2002

(65) Prior Publication Data

US 2002/0197947 A1 Dec. 26, 2002

(30) Foreign Application Priority Data

Mar. 2, 2001 (JP) ..... 2001-058998
Jan. 25, 2002 (JP) ..... 2002-016434

(51) Int. Cl.[7] ..... B24B 5/00

(52) U.S. Cl. ..... 451/541; 451/540; 451/544; 451/552; 51/307

(58) Field of Search ..... 451/541, 544, 451/546, 548, 552, 540, 527, 530, 533; 51/307, 309

(56) References Cited

U.S. PATENT DOCUMENTS 4,010,583 A * 3/1977 Highberg ..... 451/42
5,551,960 A * 9/1996 Christianson ..... 51/295
6,416,878 B2 * 7/2002 An ..... 428/565
6,419,574 B1 * 7/2002 Takahashi et al. ..... 451/548
6,485,533 B1 * 11/2002 Ishizaki et al. ..... 51/307
6,679,243 B2 * 1/2004 Sung ..... 125/12

FOREIGN PATENT DOCUMENTS

JP 10(1998)-015819 1/1998
JP 12(2000)-153463 6/2000

* cited by examiner

*Primary Examiner*—Eileen P Morgan
(74) *Attorney, Agent, or Firm*—Young & Thompson

(57) ABSTRACT

A super abrasive tool comprises scattered super abrasive grains fixed on a working surface with a bond layer. The bond layer has a flat surface and protrusions. Each protrusion has one grain and the average height from the flat surface to the top of the grain is in a specific range. A process for producing a super abrasive tool comprises forming in a spacer holes having a cylindrical portion having a diameter smaller than the average diameter of grains at the lower face and a portion having a diameter increasing to a specific value at the upper face; placing one grain in each hole; fixing the grains by forming a bond layer on the upper face of the spacer; and removing the spacer.

The super abrasive tool maintains sufficient protrusion of super abrasive grains, causes no releasing of the grains nor loading and has excellent cutting ability.

5 Claims, 5 Drawing Sheets

SUPER ABRASIVE TOOL AND PROCESS FOR PRODUCING THE SAME

BACKGROUND OF THE INVENTION

1. Field of the Invention

The present invention relates to a super abrasive tool and a process for producing the same. More particularly, the present invention relates to a super abrasive tool which maintains sufficient protrusion of super abrasive grains, causes no releasing of the super abrasive grains nor loading and has excellent cutting ability and a process for producing the same.

2. Description of Related Art

It is preferable that no releasing of abrasive grains takes place in a super abrasive tool. In particular, absolutely no releasing of super abrasive grains is allowed for CMP conditioners used for conditioning of CMP pads. In Japanese Patent Application Laid-Open No. Heisei 10(1998)-15819, a CMP conditioner in which super abrasive grains protrude from the working surface by heights in the range of 5 to 30% of the average diameter of grains is proposed as the CMP conditioner which can perform dressing of polishing pads for CMP in a short time, has no possibility of releasing of super abrasive grains and provide the polishing pad with excellent flatness. However, since a slurry formed by polishing is not removed sufficiently although releasing of the super abrasive grains can be prevented when the super abrasive grains are embedded deeply, improvement in the removal of the slurry formed by polishing is attempted by forming depressed portions such as slits and dimples or portions having no super abrasive grains on the working surface. In Japanese Patent Application Laid-Open No. Heisei 12(2000)-153463, a process for producing a CMP conditioner which comprises coating a working surface of a base metal with an adhesive at a plurality of spots separated by a specific distance between each other, temporarily attaching super abrasive grains on the adhesive on the spots and fixing the temporarily attached super abrasive grains by plating is proposed as the process for producing a CMP conditioner which exhibits suppressed abrasion of a polishing pad, maintains the surface in a constant condition and causes little releasing of the super abrasive grains. The removal of the slurry formed by polishing is improved by disposing super abrasive grains in the scattered spots and the sharpness of the CMP conditioner can be improved by decreasing the working number of the super abrasive. However, it is necessary that the depth of the embedded super abrasive grains be increased to prevent releasing of the super abrasive grains.

SUMMARY OF THE INVENTION

The present invention has an object of providing a super abrasive tool which maintains sufficient protrusion of super abrasive grains, causes no releasing of the super abrasive grains nor loading and has excellent cutting ability and a process for producing the same.

As the result of intensive studies by the present inventor to achieve the above object, it was found that a super abrasive tool which causes no releasing of the grains, can maintain sufficient protrusion of super abrasive grains and has excellent cutting ability can be obtained by forming protrusions in a bond layer on the working surface of the super abrasive tool, disposing one super abrasive grain at the top of each protrusion and adjusting the average height from the flat surface of the bond layer to the top of the super abrasive grain is in the range of 0.3 to 1.5 times the average diameter of the super abrasive grains. The present invention has been completed based on the knowledge.

The present invention provides:

(1) A super abrasive tool comprising super abrasive grains which are arranged on a working surface in a scattered manner and fixed with a bond layer, wherein the bond layer has protrusions and a flat surface at portions other than the protrusions, one super abrasive grain is disposed at each protrusion and an average height from the flat surface of the bond layer to a top of the super abrasive grain is in a range of 0.3 to 1.5 times an average diameter of the super abrasive grains;

(2) A super abrasive tool described in (1), wherein the protrusion has an average diameter at the flat surface of the bond layer in a range of 1.02 to 4 times the average diameter of the super abrasive grains;

(3) A super abrasive tool described in (1), wherein a height from the flat surface of the bond layer to a top of each super abrasive grain is distributed in a range of 0 to 1.8 times the average diameter of the super abrasive grain;

(4) A super abrasive tool described in (3), wherein super abrasive grains are further disposed on the flat surface of the bond layer;

(5) A super abrasive tool described in (1), which is a CMP conditioner;

(6) A process for producing a super abrasive tool which comprises forming, in a spacer having a thickness in a range of 0.3 to 1.5 times an average diameter of super abrasive grains, holes each having a cylindrical portion which is formed at a lower face of the spacer and has a diameter smaller than the average diameter of super abrasive grains and a portion which is connected to the cylindrical portion and has a diameter continuously increasing from the diameter of the cylindrical portion to a diameter in a range of 1.02 to 4 times the average diameter of super abrasive grains at an upper face of the spacer; placing one super abrasive grain in each hole formed above; fixing the super abrasive grains by forming a bond layer on the upper face of the spacer; and removing the spacer;

(7) A process described in (6), wherein a diameter or a length of the cylindrical portion of the hole formed at the lower face of the spacer is different among the holes;

(8) A process described in (6), wherein cylindrical holes having a same length as the thickness of the spacer are further formed in the spacer and one super abrasive grain is disposed in each of said cylindrical holes; and (9) A process described in (6), wherein the bond layer is formed on the spacer, which has super abrasive grains placed in a manner such that one super abrasive grain is placed in each hole, by conducting plating after a pressure of a plating fluid at the upper face of the spacer is made higher than a pressure of the plating fluid at the lower face of the spacer in a plating bath.

Figure 1:
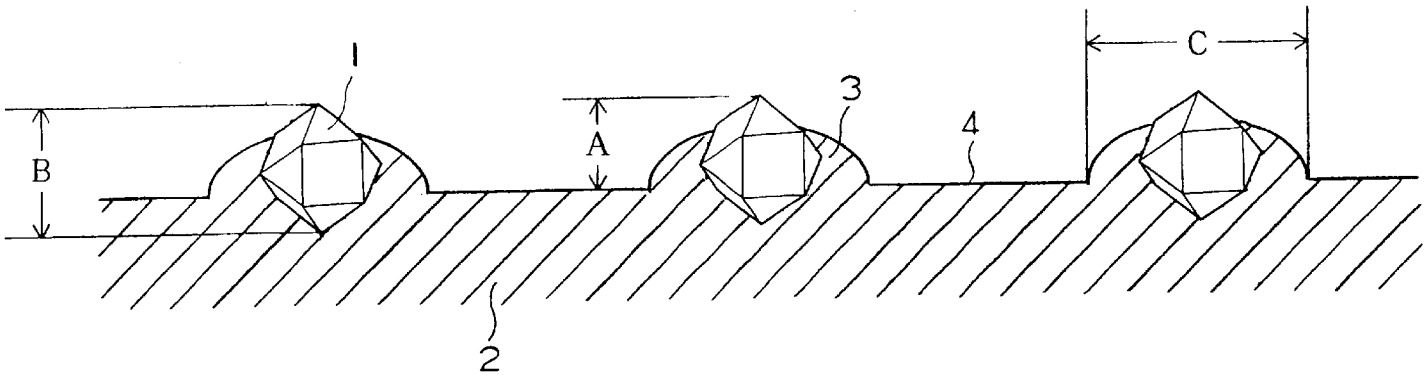
FIG. 1 shows a schematic sectional view of an embodiment of the super abrasive tool of the present invention.

The numbers in the Figures have the following meanings:

1: A super abrasive grain
2: A bond layer
3: A protrusion
4: A flat surface
5: A spacer
6: A lower face of a spacer
7: A hole
8: An upper face of a spacer
9: A hole
10: An insulating plate
11: An upper side of a spacer
12: A lower side of a spacer

DESCRIPTION OF THE PREFERRED EMBODIMENTS

The super abrasive tool comprises super abrasive grains which are arranged on a working surface in a scattered manner and fixed with a bond layer. The bond layer has protrusions and a flat surface at portions other than the protrusions. One super abrasive grain is disposed at each protrusion. The average height from the flat surface of the bond layer to the top of the super abrasive grain is in the range of 0.3 to 1.5 times the average diameter of the super abrasive grains. It is preferable in the super abrasive tool of the present invention that the protrusion has an average diameter at the flat surface of the bond layer in the range of 1.02 to 4 times the average diameter of the super abrasive grains.

FIG. 1 shows a schematic sectional view of an embodiment of the super abrasive tool of the present invention. In FIG. 1 exhibiting the present embodiment, a super abrasive grain 1, which is one of super abrasive grains arranged on a working surface in a scattered manner, is fixed with a bond layer 2. The bond layer has a protrusion 3 and a flat surface 4 at portions other than the protrusions. One super abrasive grain 1 is disposed at each protrusion 3 of the bond layer. The average height A from the surface of the flat portion of the bond layer to the top of the super abrasive grain is in the range of 0.3 to 1.5 times and preferably in the range of 0.5 to 1.2 times the average diameter B of the super abrasive grains. It is preferable that the average diameter C of the protrusion at the flat surface 4 is in the range of 1.02 to 4 times and more preferably in the range of 1.05 to 2.5 times the average diameter B of the super abrasive grain.

In the super abrasive tool of the present invention, the depth of embedding of the super abrasive grain is great since the super abrasive gains are held by the protrusion on the bond layer and there is no possibility of releasing of the super abrasive grains. It is preferable that the depth of embedding of the super abrasive grain held by the protrusion on the bond layer is 60% or more and more preferably 70% or more of the average diameter of the super abrasive grains. Since the average height A from the flat surface of the bond layer to the top of the super abrasive grain is in the range of 0.3 to 1.5 times the average diameter B of the super abrasive grain, the amount of protrusion of the super abrasive grain can be substantially maintained even when the depth of embedding exceeds 70% of the average diameter of the super abrasive. Therefore, there are no problems in removal of the slurry formed by polishing and the excellent cutting ability can be exhibited.

In conventional super abrasive tools, it is inevitable that the amount of protrusion of the super abrasive grain be suppressed to 5 to 30% of the average diameter of the super abrasive grains for completely preventing releasing of the super abrasive grains. In contrast, the amount of protrusion in the super abrasive tool of the present invention substantially corresponds to 30 to 150% of the average diameter of the super abrasive grains and remarkably more excellent cutting ability can be exhibited in comparison with that of the conventional super abrasive tools described above. When the average height from the flat surface of the bond layer to the top of the super abrasive grain is smaller than 0.3 times the average diameter of the super abrasive grains, the substantial amount of protrusion decreases and there is the possibility that the cutting ability decreases. When the average height from the flat surface of the bond layer to the top of the super abrasive grain exceeds 1.5 times the average diameter of the super abrasive grains, drawbacks arise in that, when the average diameter of the protrusion at the flat surface is small, the protrusion becomes thin and there is the possibility that the protrusion is broken and that, when the average diameter of the protrusion at the flat surface is great, the number of the effective super abrasive grain decreases due to the increase in the distance between the grains and there is the possibility that the life of the tool decreases.

In the super abrasive tool of the present invention, since the diameter C of the protrusion on the flat surface of the bond layer is in the range of 1.02 to 4 times the average diameter of the super abrasive grains, there is no possibility of releasing even when the super abrasive grain is protruded from the flat surface substantially by 30% of the average diameter of the super abrasive grains. When the diameter of the protrusion on the flat surface of the bond layer is smaller than 1.02 times the average diameter of the super abrasive grains, the bond layer holding the super abrasive grain is thin and there is the possibility that the super abrasive grains are cleaved during the use of the tool. When the diameter of the protrusion on the flat surface of the bond layer exceeds 4 times the average diameter of the super abrasive grains, the number of the working super abrasive grain decreases due to the increase in the distance between the grains and there is the possibility that the life of the tool decreases.

Figure 2:
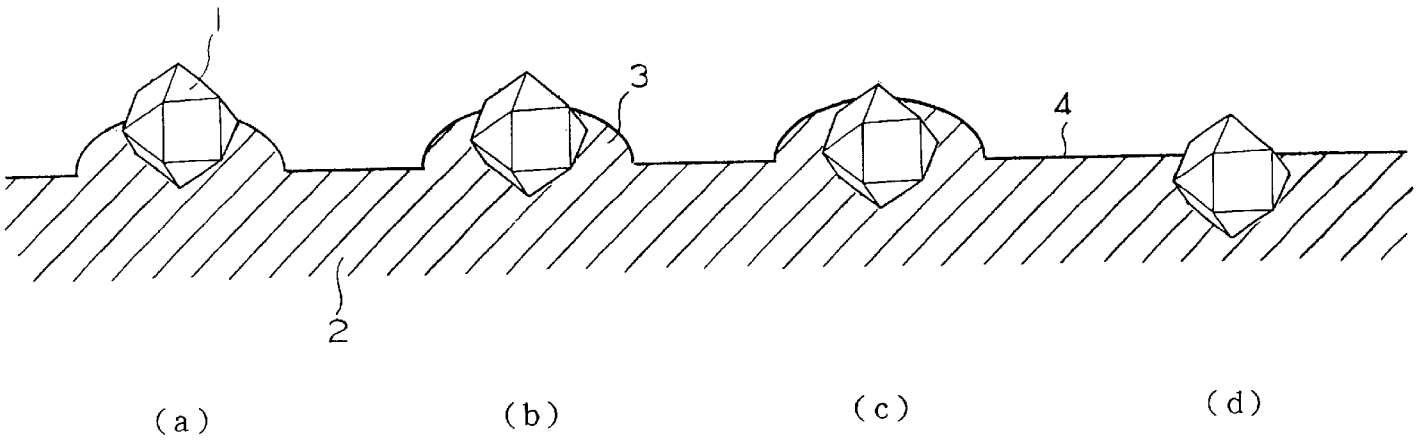
FIG. 2 shows a schematic sectional view of another embodiment of the super abrasive tool of the present invention.

In the super abrasive tool of the present invention, it is preferable that the height from the flat surface of the bond layer to the top of each super abrasive grain is distributed in the range of 0 to 1.8 times and more preferably in the range of 0.3 to 0.8 times the average diameter of the super abrasive grains. In the super abrasive tool of the present invention, super abrasive grains may be further disposed on the flat surface of the bond layer. FIG. 2 shows a schematic sectional view of another embodiment of the super abrasive tool of the present invention. In the super abrasive tool of the present embodiment, although three protrusions in which a super abrasive grain is disposed as shown by (a), (b) and (c) have the same shape, the height from the flat surface of the bond layer to the top of the super abrasive grain decrease in the order of (a), (b) and (c) due to the difference in the depth of embedding of the super abrasive grain. The super abrasive grain shown by (d) has no protrusion and fixed directly to the flat surface of the bonded layer and the height from the flat surface of the bond layer to the top of the super abrasive grain is the smallest.

Loading with products of polishing can be prevented and the cutting ability can be further improved when the height from the flat surface of the bond layer to the top of the super abrasive grain has a distribution. Moreover, in the initial stage of the use of the super abrasive tool, super abrasive grains having the tops closest to the article for polishing alone work on the article. When the tops of these super abrasive grains become dull due to abrasion, remaining super abrasive grains still having sharp tops work on the article. Therefore, the stability of the speed of polishing can be improved.

In the super abrasive tool of the present invention, any of abrasives of natural diamond, abrasives of artificial diamond and abrasives of cubic boron nitride (cBN) can be used. In the super abrasive tool of the present invention, the material of the bond layer is not particularly limited. Examples of the bond layer include resinoid bonds, metal bonds, vitrified bonds, electrically deposited metal bonds, electrocast metal bonds and brazed bonds. The application of the super abrasive tool of the present invention is not particularly limited. The super abrasive tool can be preferably applied to CMP conditioners since the tool causes no releasing of the super abrasive grains, maintains sufficient protrusion of the grains and has excellent cutting ability.

In the process for producing the super abrasive tool of the present invention, in a spacer having a thickness in the range of 0.3 to 1.5 times the average diameter of super abrasive grains, holes each having a cylindrical portion which is formed at the lower face of the spacer and has a diameter smaller than the average diameter of super abrasive grains and a portion which is connected to the cylindrical portion and has a diameter continuously increasing from the diameter of the cylindrical portion to a diameter in the range of 1.02 to 4 times the average diameter of super abrasive grains at the upper face of the spacer are formed and one super abrasive grain is placed in each hole formed above. The super abrasive grains are fixed by forming a bond layer on the upper face of the spacer and the spacer is then removed.

Figure 3:
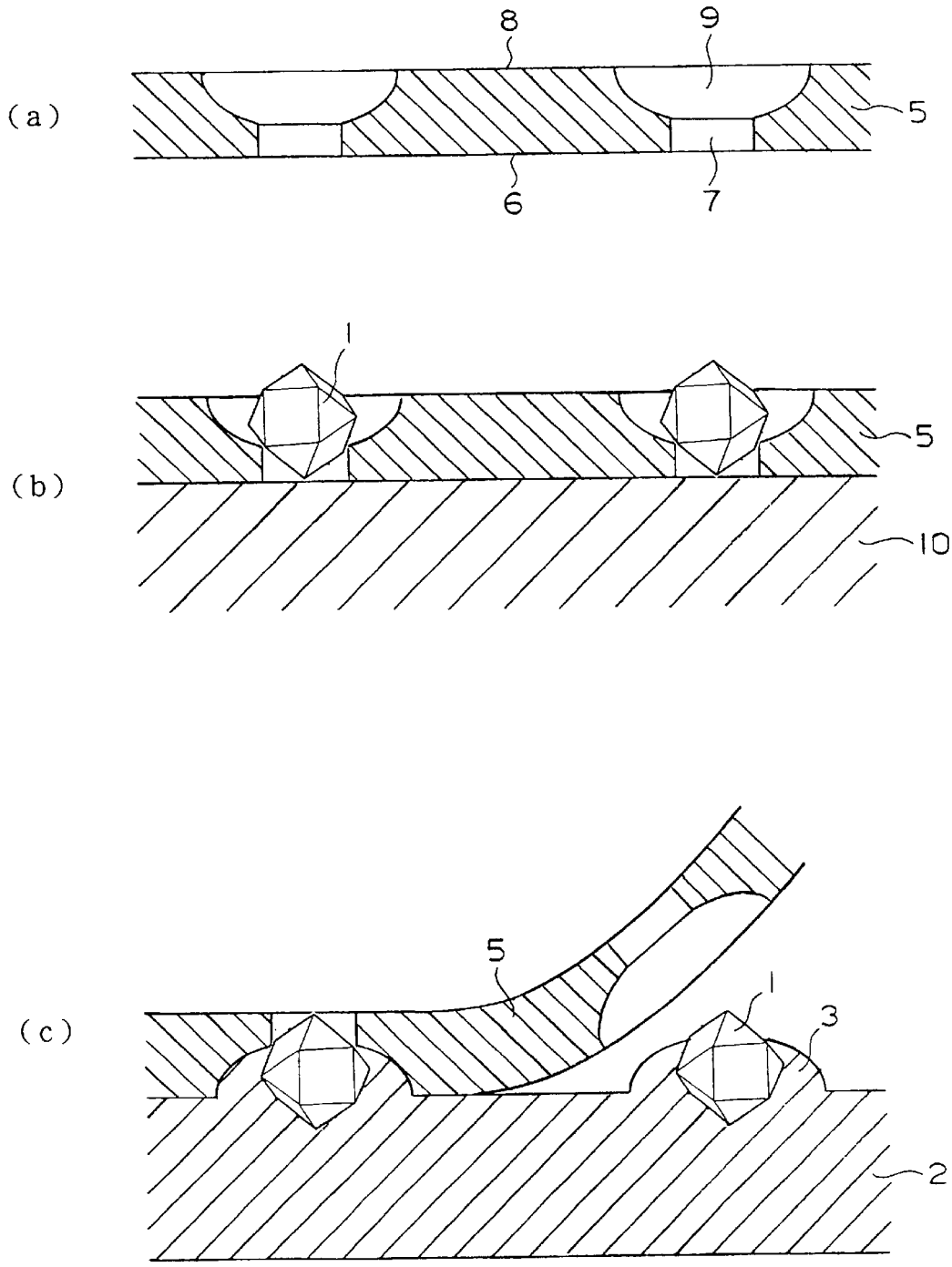
FIG. 3 shows a diagram describing an embodiment of the process for producing the super abrasive tool of the present invention.

FIG. 3 shows a diagram describing an embodiment of the process for producing the super abrasive tool of the present invention. As shown in FIG. 3(*a*), in a spacer 5 having a thickness in the range of 0.3 to 1.5 times the average diameter of the super abrasive grains, a hole having a cylindrical portion 7 which is formed at the lower face 6 of the spacer and has a diameter smaller than the average diameter of the super abrasive grains and a portion 9 which is connected to the cylindrical portion and has a diameter continuously increasing from the diameter of the cylindrical portion to a diameter in the range of 1.02 to 4 times the average diameter of the super abrasive grains at the upper face of the spacer 8 is formed. It is preferable that, in the portion which has the continuously increasing diameter, the portion close to the connection to the cylindrical portion expands more rapidly and the hole expands less rapidly at portions closer to the upper face so that the sectional shape has a shape of a bowl as shown in FIG. 3(*a*). It is not necessary that the cylindrical hole 7 has an accurate cylindrical shape. The cylindrical hole may have a shape in which the hole expands towards the lower direction or the upper direction of the spacer such as a truncated cone. The cylindrical shape is preferable due to easiness in working. The material of the spacer is not particularly limited. When the bond layer is formed with an electrocast bond, it is preferable that the material of the spacer is electrically conductive. When the bond layer is formed by nickel plating, stainless steel is preferably used for the spacer.

In the spacer in which holes have been formed, one super abrasive grain is disposed in each hole as shown in FIG. 3(*b*). Since the diameter of the cylindrical hole is smaller than the average diameter of the super abrasive grains, the super abrasive grain is suspended at the upper edge of the cylindrical hole and the top of the super abrasive grain is directed towards the lower face of the spacer as shown in FIG. 3(*b*). Moreover, since the sharp portion of the super abrasive grain becomes the top of the super abrasive grain as shown in FIG. 3(*b*), the sharp portions of the super abrasive grains in the super abrasive tool of the present invention are all arranged in the direction perpendicular to the plane of working and remarkably excellent cutting ability is exhibited. When the bond layer is formed with the electrocast metal bond, the spacer is laminated to an insulating plate 10 as shown in FIG. 3(*b*). The resultant laminate is dipped into a plating bath for electroplating and the super abrasive grains can be fixed by forming a plating layer.

After the bond layer has been formed on the spacer, the working surface can be exposed as shown in FIG. 3(*c*) by peeling the spacer 5 from the bond layer 2. Since the bond layer is not formed in the cylindrical hole 7 of the spacer, the super abrasive grain 1 is exposed. Since the bond layer is formed in the portion of the hole 9 having the continuously increasing diameter, a protrusion 3 is formed and the super abrasive grain is embedded into the protrusion and tightly held.

Figure 4:
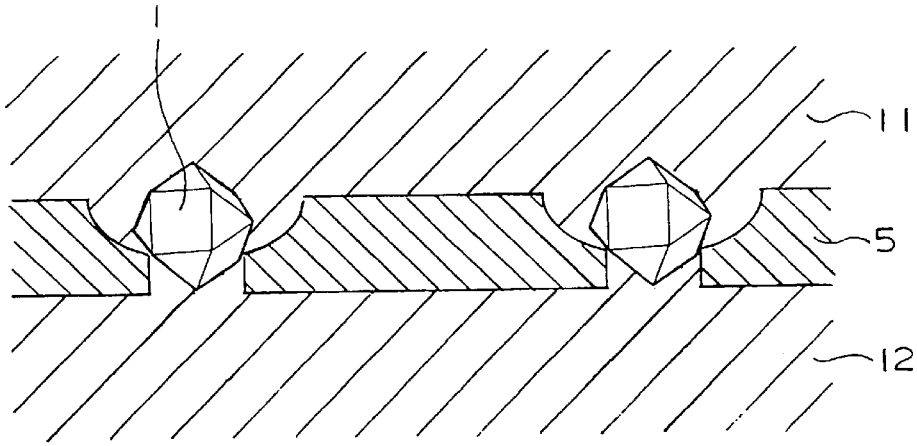
FIG. 4 shows a diagram describing another embodiment of the process for producing the super abrasive tool of the present invention.

FIG. 4 shows a diagram describing another embodiment of the process for producing the super abrasive tool of the present invention. In the present embodiment, one super abrasive grain 1 is placed in each hole of a spacer 5 having the same shape as that shown in Figure (a). The spacer having the grain is placed into a plating bath and the pressure at the upper side 11 of the spacer is made greater than the pressure at the lower side 12 of the spacer. The method for forming the difference in the pressure is not particularly limited. For example, a pressure may be added at the upper side of the spacer or the pressure at the lower side of the spacer may be reduced. By making the pressure at the upper side of the spacer greater than the pressure at the lower side of the spacer, a flow of the plating fluid from the upper side of the spacer to the lower side of the spacer through the gap between the super abrasive grain and the hole is generated and the super abrasive grain is pushed toward the hole. The gap between the super abrasive grain and the hole decreases and the flow of the plating fluid almost stops. As the result, the sharp tips of all super abrasive grains are surely arranged in the direction perpendicular to the working surface. Since the gap between the super abrasive grain and the hole is small, the coating layer does not grow much at the cylindrical portion of the hole and the coating layer formed in a small amount is removed together with the spacer when the spacer is peeled. Therefore, no coating layer remains around the top of the super abrasive grain used for cutting. After the bond layer is formed on the spacer and the super abrasive gains are fixed, the spacer 5 is peeled from the bond layer in the same manner as that shown in FIG. 3(*c*) and the working surface is exposed.

Figure 5:
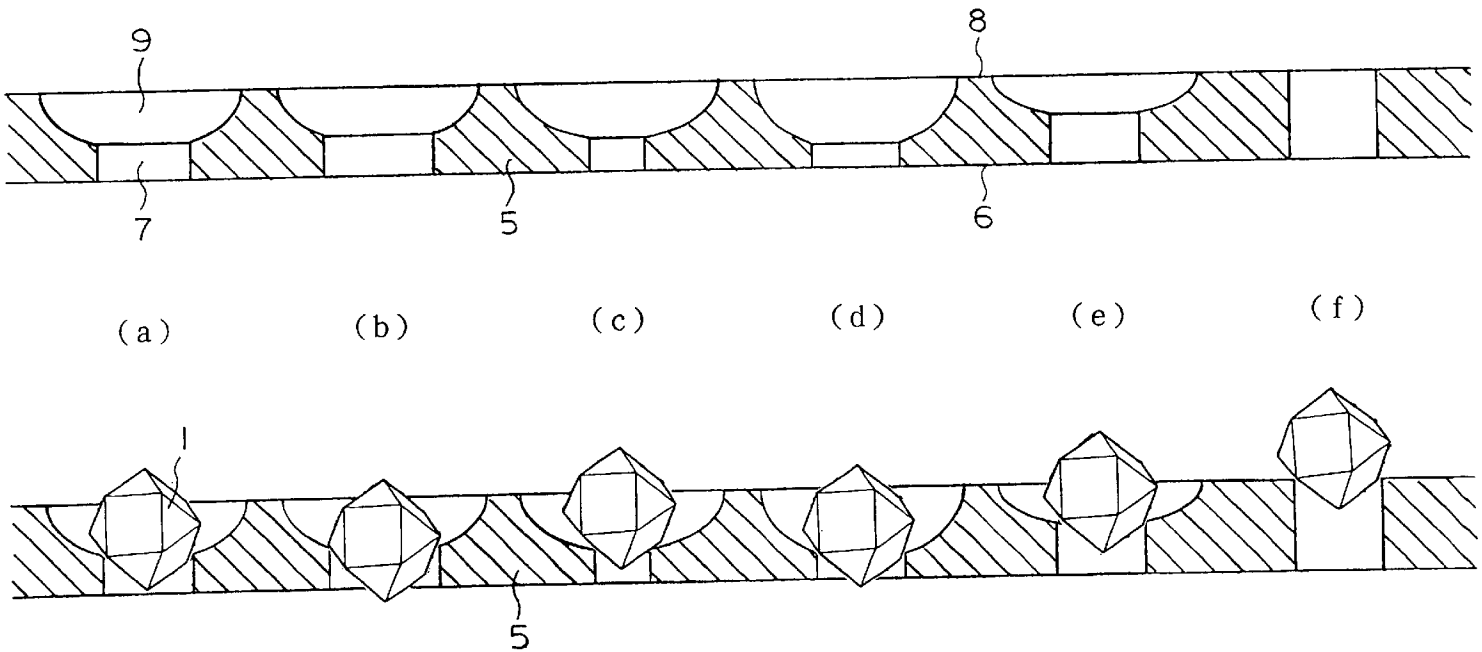
FIG. 5 shows a diagram describing still another embodiment of the process for producing the super abrasive tool of the present invention.

FIG. 5 shows a diagram describing still another embodiment of the process for producing the super abrasive tool of the present invention, which describes the method for adjusting the height from the flat surface of the bond layer to the top of the super abrasive grain. The upper diagram shows a sectional view of holes formed in a spacer and the lower diagram shows a schematic sectional view exhibiting the condition in which the super abrasive grains are placed in the holes. The hole shown in FIG. 5(*b*) has a greater diameter of the cylindrical portion than that of the hole shown in FIG. 5(*a*). Due to the greater diameter of the cylindrical portion, the height from the flat surface of the bond layer to the top of the super abrasive grain can be increased. The hole shown in FIG. 5(*c*) has a smaller diameter of the cylindrical portion than that of the hole shown in FIG. 5(*a*). Due to the smaller diameter of the cylindrical portion, the height from the flat surface of the bond layer to the top of the super abrasive grain can be decreased. The hole shown in FIG. 5(*d*) has a smaller length of the cylindrical portion than that of the hole shown in FIG. 5(*a*). Due to the smaller length of the cylindrical portion, the height from the flat surface of the bond layer to the top of the super abrasive grain can be increased. The hole shown in FIG. 5(*e*) has a greater length of the cylindrical portion than that of the hole shown in FIG. 5(*a*). Due to the greater length of the cylindrical portion, the height from the flat surface of the bond layer to the top of the super abrasive grain can be decreased. The hole shown in FIG. 5(*f*) is a cylindrical hole penetrating through the spacer and having a length which is the same as the thickness of the spacer. By placing the super abrasive grain on the hole having this shape, the height from the flat surface of the bond layer to the top of the super abrasive grain can be decreased.

To summarize the advantages obtained by the present invention, the super abrasive tool of the present invention maintains sufficient protrusion of super abrasive grains, causes no releasing of the grains nor loading and has excellent cutting ability. In accordance with the process of the present invention, the super abrasive tool having the above advantages can be produced easily in the condition such that the sharp tops of the super abrasive grains are placed at the most protruded position of the gains.

EXAMPLES

The present invention will be described more specifically with reference to examples in the following. However, the present invention is not limited to the examples.

Example 1

In a circular portion having a diameter of 120 mm on a stainless steel sheet having a thickness of 144 μm, a square grid having a distance between grid lines of 0.625 mm was assumed to be formed and holes having the shape shown in FIG. 3(*a*) were formed at the intersections of the grid lines. The hole had the following shape: the portion from the lower face of the sheet to the height of 50 μm had a cylindrical shape having a diameter of 150 μm and the portion from the height of 50 μm to the upper face of the sheet had a shape of a bowl in which the diameter continuously increased from the height of 50 μm to the upper face of the sheet and the diameter at the upper face of the sheet was 300 μm. The circular portion having a diameter of 120 mm in which the holes had been formed was cut out and used as the spacer.

A plate of an acrylic resin was laminated to the lower face of the spacer. Diamond abrasive grains having an average diameter of 180 μm were placed in the holes in a manner such that one grain was placed in each hole in the condition shown in FIG. 3(*b*). The spacer having the super abrasive grains was dipped into a plating bath of nickel sulfamate and plating was conducted under an electric current of 1 $A/dm^2$ for 21 hours so that a plating layer having a thickness of about 250 μm was formed.

The spacer having the plating layer on the upper face was separated from the plate of an acrylic resin and turned upside down. The spacer was then peeled in the manner shown in FIG. 3(*c*). A layer having diamond abrasive grains was obtained as described above. In the layer, the average height from the flat surface of the plating layer to the top of the diamond abrasive grain was 0.8 times the average diameter of the diamond abrasive grains and the depth of embedding of the diamond abrasive grains was 72% of the average diameter of the diamond abrasive grains. The layer having diamond abrasive grains was adhered to a base metal of 120D×12T made of stainless steel with an epoxy adhesive and a CMP conditioner was completed.

Using the obtained CMP conditioner, conditioning of a pad for CMP was conducted. A pad [manufactured by RODEHL NITTA Co., Ltd.; IC-1000] was attached to a CMP apparatus [manufactured by BULER Company; ECOMET4] and 20 runs of the conditioning were conducted for 2 minutes in each run using an aqueous solution of potassium hydroxide containing fine particles of silica and having a pH of 10.5 as the polishing fluid under a load of 19.6 kPa on the CMP conditioner at a rotation speed of the pad of 100 $min^{-1}$ and a rotation speed of the conditioner of 56 $min^{-1}$. The speed of removal of the pad was 156 μm/hour and the standard deviation thereof was 8.6 μm/hour as the average values in 20 runs.

Example 2

In a circular portion having a diameter of 120 mm on a stainless steel sheet having a thickness of 144 μm, 55 concentric circles having diameters increasing at a pitch of 0.7 mm from 44 mm to 119.6 mm were drawn and straight lines were drawn through the center of the circle at an angle between the adjacent lines of 0.8°. Holes having the shape shown in FIG. 3(*a*) were arranged at intersections of the circles and the straight lines.

The total number of the holes having the shape shown in FIG. 3(*a*) which were arranged at the intersections was 24,750. The 28th circle is at the middle of the circles. The holes on the 27th to 29th circles from the center had the following shape: the portion from the lower face of the sheet to the height of 50 μm had a cylindrical shape having a diameter of 190 μm and the portion from the height of 50 μm to the upper face of the sheet had a shape of a bowl in which the diameter continuously increased from the height of 50 μm to the upper face of the sheet and the diameter at the upper face of the sheet was 300 μm.

In the holes arranged at the outside of the above holes, the diameter of the cylindrical holes was changed in a manner such that the diameter of the cylindrical holes on three succeeding outer circles was smaller than the diameter of the cylindrical holes on three preceding inner circles by 5 μm. Specifically, the diameter of the holes on the 30th to 32nd circles was 185 μm, the diameter of the holes on the 33rd to 35th circles was 180 μm, the diameter of the holes on the 36th to 38th circles was 175 μm and the diameter of the holes on the 39th to 41st circles was 170 μm. The diameter was made smaller in the same manner and the diameter of the holes on the 51st to 53rd circles was 150 μm. The holes on the 54th circle had a cylindrical shape which penetrated from the lower surface to the upper surface of the sheet and had a diameter of 130 μm. The holes on the 55th circle had a similar cylindrical shape having a diameter of 110 μm. In the first to the 26th holes from the center of the circle, the diameter of the cylindrical holes was changed in a manner such that the diameter of the cylindrical holes on three succeeding inner circles was smaller than the diameter of the cylindrical holes on three preceding outer circles by 5 μm. The holes on the second circle had a cylindrical shape which penetrated from the lower surface to the upper surface of the sheet and had a diameter of 130 μm. The holes on the first circle had a similar cylindrical shape having a diameter of 110 μm. The circular portion having a diameter of 120 mm in which holes had been formed was cut out and used as the spacer.

Diamond grains having an average diameter of 280 μm were placed in the holes in a manner such that one grain was placed in each hole. The spacer having the super abrasive grains was dipped into a plating bath of nickel sulfamate to form the condition shown in FIG. 4. The pressure at the upper side of the spacer was made higher than the pressure at the lower side of the spacer and the plating was conducted under an electric current of 2 A/dm$^2$ for 21 hours so that a plating layer having a thickness of about 500 μm was formed.

The spacer having the plating layer on the upper surface was taken out of the plating bath and turned upside down. The spacer was then peeled in a manner shown in FIG. 3(*c*). A layer having diamond abrasive grains was obtained as described above. In the layer, entire protrusions had the same shape, the amount of embedding of the diamond abrasive grains was distributed in the range of 67 to 85% of the average diameter of the grains and the height from the flat surface of the plating layer to the top of the diamond abrasive grain was distributed in the range of 0.3 to 0.6 times the average diameter of the diamond abrasive grains. The layer having diamond abrasive grains was adhered to a base metal of 120D×12T made of stainless steel with an epoxy adhesive and a CMP conditioner was completed.

Using the obtained CMP conditioner, 20 runs of the conditioning were conducted in accordance with the same procedures as those conducted in Example 1. The speed of removal of the pad was 170 μm/hour and the standard deviation thereof was 9.0 μm/hour as the average values in 20 runs.

Comparative Example 1

Diamond abrasive grains having the same diameter as that in Example 1 were fixed in the same dimension as that in Example 1 in accordance with the conventional electrodeposition process and a CMP conditioner was prepared.

On the working surface of a base metal of 120D×12T made of nickel metal, a masking tape which had holes having a diameter of 230 μm at positions corresponding to intersections of grid lines in a grid having a distance between grid lines of 0.625 mm was attached. Diamond abrasive grains having an average diameter of 180 μm were placed in the holes of the masking tape in a manner such that one grain was placed in each hole. The diamond abrasive grains placed in the holes were temporarily fixed on the working surface of the base metal using an adhesive [manufactured by CEMEDINE Co., Ltd.; INDUSTRIAL CEMEDINE]. The masking tape on the working surface was then removed and portions other than the working surface was masked. The base metal having the diamond abrasive was dipped into the same nickel plating bath as that used in Example 1 and the plating was conducted under an electric current of 1 A/dm$^2$ for 10 hours. The diamond abrasive grains were thus fixed by forming a plating layer having a thickness of about 125 μm and a CMP conditioner was completed.

Using the obtained CMP conditioner, 20 runs of the conditioning was conducted in accordance with the same procedures as those conducted in Example 1. The speed of removal of the pad was 130 μm/hour and the standard deviation thereof was 18.0 μm/hour as the average values in 20 operations.

The results obtained in Examples 1 and 2 and Comparative Example 1 are shown in Table 1.

TABLE 1

| | Speed of removal of pad (μm/hour) | |
|---|---|---|
| | average value | standard deviation |
| Example 1 | 156 | 8.6 |
| Example 2 | 170 | 9.0 |
| Comparative Example 1 | 130 | 18.0 |

As shown in Table 1, in Examples 1 and 2 in which the conditioning was conducted using the CMP conditioner of the present invention, the average value of the speed of removal of the pad was greater and the standard deviation was smaller than those in Comparative Example 1 in which the conventional CMP conditioner was used. Thus, it is shown that the CMP conditioner of the present invention exhibited more excellent cutting ability and smaller fluctuations.

What is claimed is:

1. A super abrasive tool comprising super abrasive grains which are arranged on a working surface in a scattered manner and fixed with a bond layer, wherein the bond layer has protrusions and a flat surface at portions other than the protrusions, one super abrasive grain is disposed at each protrusion and an average height from the flat surface of the bond layer to a top of the super abrasive grain is in a range of 0.3 to 1.5 times an average diameter of the super abrasive grains.

2. A super abrasive tool according to claim 1, wherein the protrusion has an average diameter at the flat surface of the bond layer in a range of 1.02 to 4 times the average diameter of the super abrasive grains.

3. A super abrasive tool according to claim 1, wherein a height from the flat surface of the bond layer to a top of each super abrasive grain is distributed in a range of 0 to 1.8 times the average diameter of the super abrasive grain.

4. A super abrasive tool according to claim 3, wherein super abrasive grains are further disposed on the flat surface of the bond layer.

5. A super abrasive tool according to claim 1, which is a CMP conditioner.

* * * * *